United States Patent [19]

Allam et al.

[11] Patent Number: 4,842,625

[45] Date of Patent: Jun. 27, 1989

[54] CONTROL METHOD TO MAXIMIZE ARGON RECOVERY FROM CRYOGENIC AIR SEPARATION UNITS

[75] Inventors: Rodney J. Allam, Guildford; Alan L. Prentice, Surbiton, both of United Kingdom

[73] Assignee: Air Products and Chemicals, Inc., Allentown, Pa.

[21] Appl. No.: 187,683

[22] Filed: Apr. 29, 1988

[51] Int. Cl.[4] ..... F25J 3/04

[52] U.S. Cl. ..... 62/22; 62/31; 62/34

[58] Field of Search ..... 62/9, 11, 22, 23, 31, 62/32, 34, 36, 38, 39

[56] References Cited

U.S. PATENT DOCUMENTS

| | | | |
|---|---|---|---|
| 3,729,943 | 5/1973 | Petit | 62/22 |
| 4,128,684 | 12/1978 | Bomio et al. | 428/175 |
| 4,186,159 | 1/1980 | Huber | 261/112 |
| 4,296,050 | 10/1981 | Meier | 261/112 |
| 4,455,339 | 6/1984 | Meier | 428/175 |
| 4,497,751 | 2/1985 | Pluss | 261/94 |
| 4,497,752 | 2/1985 | Huber | 261/95 |
| 4,497,753 | 2/1985 | Streiff | 261/95 |
| 4,533,375 | 8/1985 | Erickson | 62/22 |
| 4,575,388 | 3/1986 | Okada | 62/22 |
| 4,578,095 | 3/1986 | Erickson | 62/22 |
| 4,604,116 | 8/1986 | Erickson | 62/13 |
| 4,605,427 | 8/1986 | Erickson | 62/22 |
| 4,615,716 | 10/1986 | Cormier et al. | 62/22 X |
| 4,670,031 | 6/1987 | Erickson | 62/22 |
| 4,715,874 | 12/1987 | Erickson | 62/22 |
| 4,737,177 | 4/1988 | Erickson | 62/22 |

*Primary Examiner*—Steven E. Warner

*Attorney, Agent, or Firm*—Willard Jones, II; James C. Simmons; William F. Marsh

[57] ABSTRACT

The present invention relates to an improvement to a conventional cryogenic air separation process having an argon sidearm column. The improvement to the process comprises reducing the pressure of the feed gas to the argon sidearm column across a control valve and operating the argon sidearm column at the lowest possible pressure consistent with a minimum temperature difference across the overhead condenser and the unrestricted return of crude oxygen vapor from the overhead condenser to the low pressure column.

5 Claims, 2 Drawing Sheets

CONTROL METHOD TO MAXIMIZE ARGON RECOVERY FROM CRYOGENIC AIR SEPARATION UNITS

TECHNICAL FIELD

The present invention relates to a process for the separation of air into its constituent components. More specifically, the present invention relates to a control method to maximize argon recovery in air separation processes.

BACKGROUND OF THE INVENTION

Numerous processes are known for the separation of air by cryogenic distillation into its constituent components, representative among these are U.S. Pat. Nos. 3,729,943; 4,533,375; 4,578,095; 4,604,116; 4,605,427; 4,670,031 and 4,715,874.

In addition, examples of structured or ordered packings are known in the art, representative among these are U.S. Pat. Nos. 4,128,684; 4,186,159; 4,296,050; 4,455,339; 4,497,751; 4,497,752 and 4,497,753.

SUMMARY OF THE INVENTION

The present invention relates to an improvement to a process for the separation of mixtures, which comprise oxygen, nitrogen, and argon, (e.g. air) by cryogenic distillation in a distillation unit comprising an argon sidearm column with an overhead condenser and a low pressure column. The argon sidearm column integrally communicates with the low pressure column. The improvement of the present invention is for increasing argon recovery and comprises reducing the pressure of feed gas withdrawn from a lower-intermediate location of the low pressure column and fed to a lower location of the argon sidearm column whereby the operating pressure of the argon sidearm column is controlled at the lowest effective pressure which is consistent with a minimum temperature difference across the overhead condenser and an unrestricted return of crude oxygen vapor from the overhead condenser of the argon sidearm column to the low pressure column. The preferred pressure range for the feed gas is from about 1.5 psig to about 15 psig. The present invention is most particularly suited for a process utilizing a structured packing in both the low pressure column and the argon sidearm column.

DETAILED DESCRIPTION OF THE INVENTION

The present invention relates to an improvement to a process for the separation of mixtures comprising oxygen, nitrogen and argon, e.g. air, by cryogenic distillation in a distillation unit comprising an argon sidearm column and a low pressure column, wherein the argon sidearm column integrally communicates with the low pressure column. Essentially, the improvement of the present invention is for increasing argon recovery and comprises reducing the pressure of feed gas withdrawn from a lower location of the low pressure column and fed to a lower location of the argon sidearm column across a control valve whereby the operating pressure of the argon sidearm column is controlled at the lowest effective pressure which is consistent with a minimum temperature difference across the overhead condenser and an unrestricted return of crude oxygen vapor from the overhead condenser of the argon sidearm column to the low pressure column. The process is applicable for distillation columns utilizing either conventional internals, i.e. trays, or structured packings, however, the benefits of the present invention are most evident in distillation columns utilizing a structured packing.

The present invention particularly relates to the problem of maximizing argon recovery from a cryogenic air separation plant using a conventional double column with an argon sidearm column, in which the low pressure and argon sidearm columns are fitted with either structured packing or conventional distillation trays. The process of the present invention is best understood with reference to a typical air separation process having such a three column distillation unit. These three columns are called the high pressure column, the low pressure column and the argon column. Examples of air separation processes which separate argon and oxygen and produce both as products are shown in U.S. Pat. Nos. 3,729,943; 4,533,375; 4,578,095; 4,604,116; 4,605,427; 4,670,031 and 4,715,874, the specifications of which are incorporated herein by reference. A typical flowsheet illustrating the application of the present invention is shown in FIG. 1.

Figure 1:
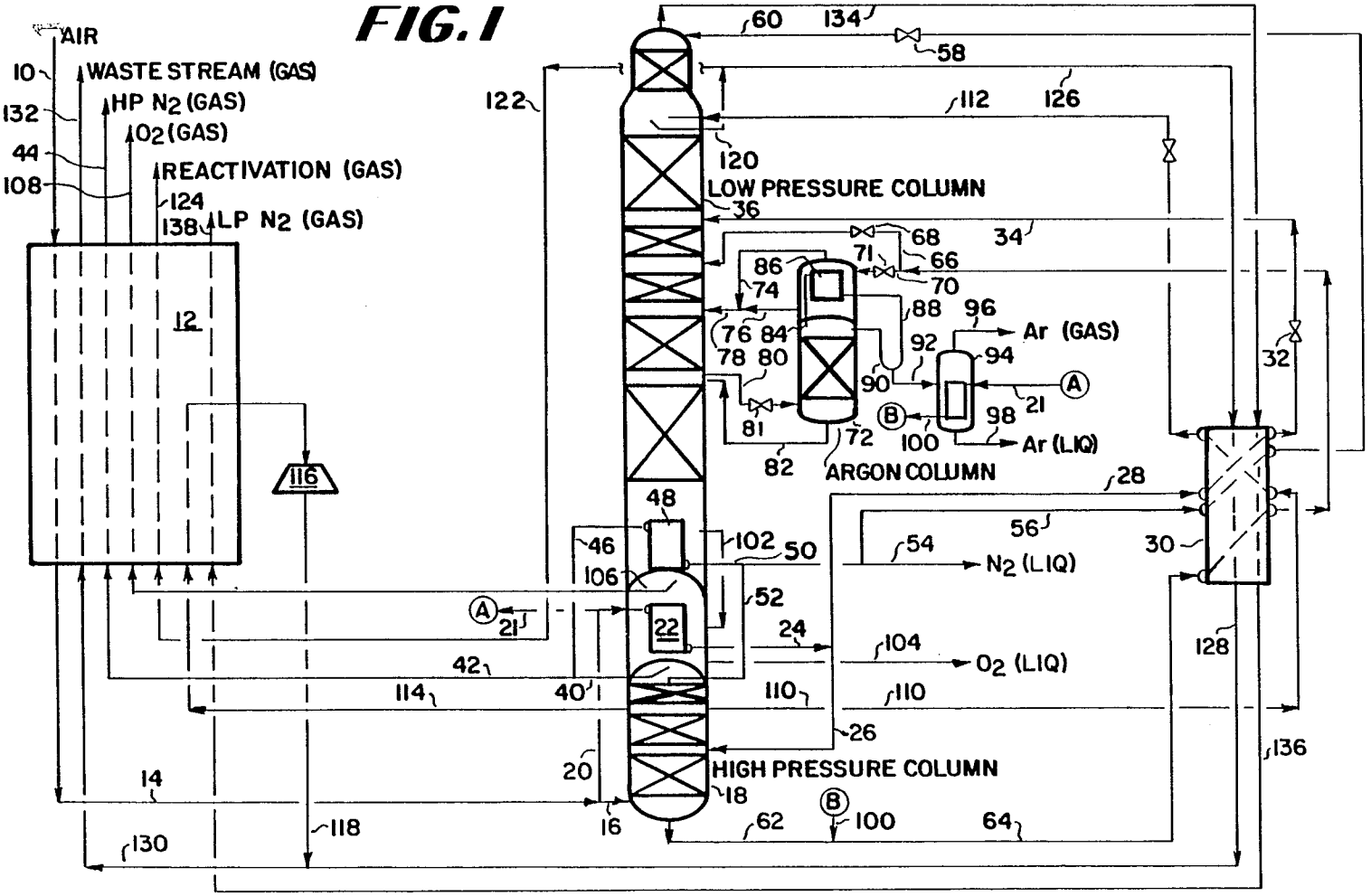
FIG. 1 is a schematic diagram of the process of the present invention which utilizes a three distillation column unit producing argon and oxygen products.

With reference to FIG. 1, compressed air at near ambient temperature is fed via line 10 to heat exchanger 12 wherein it is cooled to close to its dew point. Water and carbon dioxide are removed from this feed air by mole sieve adsorption (not shown). This removal can also be accomplished by alternating the flow of air and a low pressure returning stream in heat exchanger 12, i.e. a reversing heat exchanger. This cooled, compressed, impurity-free air, now in line 14, is then split into two portions. The first portion is fed via line 16 to a lower location in high pressure column 18. The second portion, in line 20, is further split into two portions. The first portion is fed to argon product vaporizer 94 via line 21 and the second portion is fed to and condensed in product vaporizer 22 to provide boiling of liquid oxygen in the sump surrounding product vaporizer 22, and removed from product vaporizer 22 via line 24. The condensed liquid, in line 24, is then separated into two portions, the first portion which is fed as feed to an intermediate location of high pressure column 18 via line 26 and the second portion, in line 28, which is subcooled in heat exchanger 30 flashed in J-T valve 32 and fed into an intermediate location of low pressure column 36 via line 34.

Overhead is removed from high pressure column 18 via line 40 and then divided into two portions. The first portion is warmed in main heat exchanger 12 to recover refrigeration and then removed as high pressure nitrogen product via line 44. The second portion is fed via line 46 to reboiler/condenser 48 located in the bottom of low pressure column 36 wherein it is condensed and removed via line 50. This condensed pure nitrogen stream is then split into three portions. The first portion is fed via line 52 to the top of high pressure column 18 to provide reflux to high pressure column 18. The second portion is removed as liquid nitrogen product via line 54, and the third portion, removed via line 56, is subcooled in heat exchanger 30, flashed in J-T valve 58 and fed to the top of low pressure column 36 via line 60, to provide a pure nitrogen reflux to the top hat portion of low pressure column 36. As an option, the second portion in line 54 can be subcooled in subcooler 30 before being removed as product.

Oxygen-enriched liquid bottoms from high pressure column 18 is removed via line 62. This stream is combined with stream 100, a condensed air stream from argon product vaporizer 94, to form combined oxygen-enriched liquid stream 64. This combined liquid stream is subcooled in heat exchanger 30 and then split into two substreams. The first substream, line 66, is flashed in J-T valve 68 and fed into an upper-intermediate location of low pressure column 36. The second substream, line 70, is flashed in J-T valve 71 and fed to the sump surrounding condenser 86 located at the top of argon column 72 to provide refrigeration for condenser 86. A gaseous overhead is removed from the overhead portion of the sump surrounding condenser 86 via line 74 and is combined with a small liquid stream 76 also removed from the sump surrounding condenser 86 to form combined stream 78. Stream 76 is withdrawn for safety reasons; this withdrawal prevents the accumulation of hydrocarbons in the sump surrounding condenser 86. This combined stream 78 is then fed into an intermediate location of low pressure column 36.

A side stream is removed from a lower-intermediate location of low pressure column 36 via line 80, reduced in pressure in control valve 81 and fed to a lower portion of argon column 72. The bottoms liquid from argon column 72 is returned via line 82 to low pressure column 36 at the same location as the side stream 80 draw in order to provide intermediate column reflux. Overhead argon is removed from argon column 72 via line 84, condensed in condenser 86 and split into two portions. The first portion is returned to the top of argon column 72 via line 90 to provide reflux to argon column 72. The second portion is removed and fed via line 92 to argon product vaporizer 94. Argon gas product is removed from product vaporizer 94 via line 96 and argon liquid product is removed from product vaporizer 94 via line 98.

A bottoms liquid stream is removed from low pressure column 36 (the bottom sump surrounding reboiler/condenser 48) and fed to the sump surrounding product vaporizer 22 via line 102. Gaseous oxygen product is removed from the overhead of the sump surrounding product vaporizer 22 via line 106, warmed to recover refrigeration in main heat exchanger 12 and removed as gaseous oxygen product via line 108. A liquid oxygen product is removed from a lower portion of the sump surrounding product vaporizer 22 as liquid oxygen product via line 104.

A liquid side stream is removed via line 110 from an intermediate location of high pressure column 18. This impure liquid side stream is subcooled in heat exchanger 30, reduced in pressure and fed as reflux an upper portion of low pressure column 36 via line 112. In addition, a gaseous side stream is removed via line 114 from a similar location of high pressure column 18. This side stream is warmed in main heat exchanger 12 to recover refrigeration and work expanded in expander 116 to recover refrigeration. This expanded stream is now in stream 118.

A gaseous side stream is removed via line 120 from an upper location of low pressure column 36 and split into two portions. The first portion, in line 122, is warmed in heat exchanger 12 to recover refrigeration, used as reactivation gas and removed from the process via line 124. Reactivation gas is necessary to reactivate a mole sieve adsorption unit which is used to remove water and carbon dioxide from compressed feed air. If reactivation gas is unnecessary, then stream 124 would be vented to the atmosphere as waste. The second portion of the side stream, line 126, is warmed in heat exchanger 30 to recover refrigeration and combined with expanded stream 118 to form combined stream 130. This combined stream 130 is then warmed in heat exchanger 12 to recover any residual refrigeration and vented as waste via line 132.

Finally, an overhead from low pressure column 36 is removed via line 134 and warmed in heat exchanger 30 to recover refrigeration. This warmed overhead, now in line 136, is further warmed in heat exchanger 12 to recover any residual refrigeration and removed as low pressure nitrogen product via line 138.

The distillation columns in the above process would utilize internals which are either distillation trays or structured packing.

The first option is the use of distillation trays. Although dependent upon the selected cycle, product makes, and relative values of power and capital, typical theoretical tray counts for the high pressure column, low pressure column and argon column are; 50, 70 and 40 respectively. Typically, specially designed distillation trays have been used within the columns to effect the separation. These distillation trays are generally designed with a tray spacing ranging from 4 to 8 inches. For large plants, sieve trays are usually used. The hole area is typically 5 to 15% of the tray area.

The second option is the use of structured packing. By the term structured or ordered packing, it is meant a packing in which liquid flows over shaped surfaces in a countercurrent direction to the gas flow and wherein the surface is arranged to give high mass transfer for low pressure drop with the promotion of liquid and/or vapor mixing in a direction perpendicular to the primary flow direction. Examples of ordered or structured packings are disclosed in U.S. Pat. Nos. 4,128,684; 4,186,159; 4,296,050; 4,455,339; 4,497,751; 4,497,752 and 4,497,753, the specifications of which are incorporated herein by reference. These patents disclose specific examples of structured (ordered) packings, however, they do not present an exhaustive list of examples. It should be noted that it is not the intention of the present invention to prefer one type of structured packing over another. All types of structured packings are believed to be applicable to the present invention.

The use of structured packing is justified economically by firstly the reduction in air pressure and air compressor power due to the greatly reduced pressure drop through the low pressure column packing and secondly by the increase in argon recovery which is achieved because of the lower pressures in the low pressure and argon sidearm columns which increase the relative volatility of argon compared with oxygen.

In either case (trays or structured packing), in conventional air separation processes, the temperature difference (DT) across the overhead condenser of the sidearm column is greater than required by the condenser:

| Distillation Device | | Structured Packing | Distillation Trays |
|---|---|---|---|
| Available DT in | °C. | 3.0 | 2.2 |
| overhead condenser | °F. | 5.4 | 4 |
| Min DT required by | °C. | 1.1 | 1.1 |
| overhead condenser | °F. | 2 | 2 |

This means that there is scope to operate the argon column at a lower pressure than at the feed point from the low pressure column so that the temperature difference across the overhead condenser is 1.1° C. (2° F.). The lower pressure will cause higher argon recovery due to the increase in relative volatility.

Figure 2:
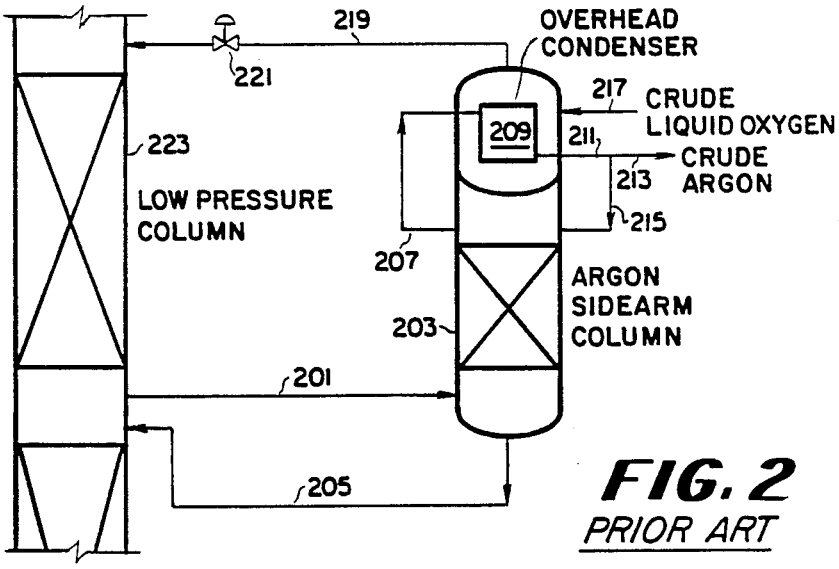
FIG. 2 PRIOR ART
FIG. 2 is a schematic diagram of the control system utilized in a conventional three distillation column unit.

This large temperature difference is a major source of inefficiency using the conventional control system, which is shown in FIG. 2, in which there is no restriction in feed gas flow from the low pressure column to the argon sidearm column, and in which the flow is regulated by back pressure control on the crude oxygen vapor leaving the overhead condenser.

With reference to FIG. 2, showing a conventional control system for an argon sidearm column, a side stream is removed from a lower intermediate location of low pressure column 223 via line 201, and fed to a lower portion of argon column 203. The bottoms liquid from argon column 203 is returned, via line 205, to low pressure column 223 at the same location as the side stream 201 draw in order to provide intermediate column reflux for column 223. Overhead argon is removed from argon column 203 via line 207 and condensed in condenser 209. The condensed argon is removed from condenser 209 via line 211 and split into two portions. The first portion is returned to the top of argon column 203 via line 215 to provide reflux to argon column 203. The second portion is removed via line 213 as crude argon product. As heat exchange for condenser 209, crude liquid oxygen is fed to the sump surrounding condenser 209. Vaporized crude oxygen is removed from the sump surrounding condenser 209 via line 219, reduced in pressure across control valve 221 and fed to low pressure column 223 as intermediate feed. In addition to this vapor flow, a small liquid flow is also removed from the sump surrounding condenser 209 and returned to the low pressure column (not shown). This liquid flow is required for safety reasons to prevent the accumulation of hydrocarbons in the sump surrounding condenser 209.

Figure 3:
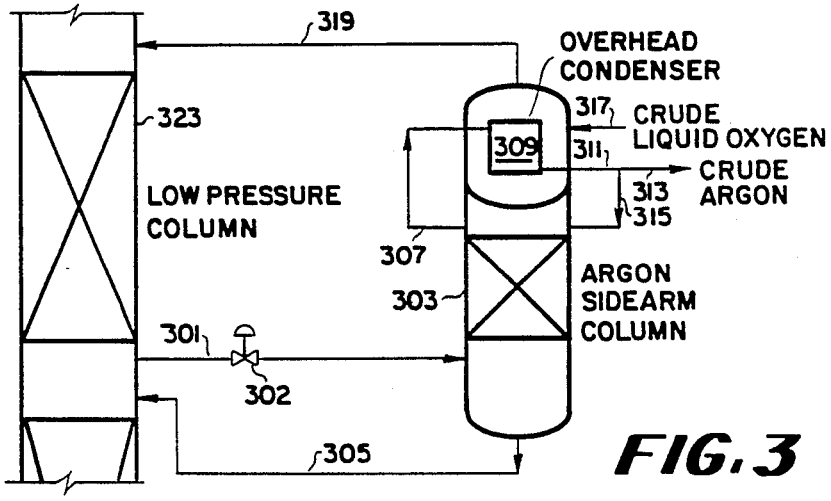
FIG. 3 is a schematic diagram of the control system utilized in the process of the present invention.

The alternative to this control system is that of the present invention which is shown in FIG. 3. The control system of the present invention consists of a control valve placed in the gas feed line from the low pressure column to the argon sidearm column which reduces the pressure in the argon sidearm column below that in the low pressure column to a minimum value such that the temperature differences across the overhead condenser is reduced to its minimum economic value and that there is no restriction on crude oxygen vapor flow from the overhead condenser to the low pressure column.

A more detailed description of the control system operation is as follows. With reference to FIG. 3, a side stream is removed from a lower-intermediate location of low pressure column 323 via line 301, reduced in pressure across control valve 302, and fed to a lower portion of argon column 303. The bottoms liquid from argon column 303 is returned, via line 305, to low pressure column 323 at the same location as the side stream 301 draw in order to provide intermediate column reflux for column 323. Overhead argon is removed from argon column 303 via line 307 and condensed in condenser 309. The condensed argon is removed from condenser 309 via line 311 and split into two portions. The first portion is returned to the top of argon column 303 via line 315 to provide reflux to argon column 303. The second portion is removed via line 313 as crude argon product. As heat exchange for condenser 309, crude liquid oxygen is fed to the sump surrounding condenser 309. Vaporized crude oxygen is removed from the sump surrounding condenser 309 via line 319 and fed to low pressure column 323 as intermediate feed. In addition to this vapor flow, a small liquid flow is also removed from the sump surrounding condenser 309 and returned to the low pressure column (not shown). This liquid flow is required for safety reasons to prevent the accumulation of hydrocarbons in the sump surrounding condenser 309.

To further expand on the two control systems, the conventional control scheme provides control of the crude argon column flow by adjusting the pressure of the boiling crude liquid oxygen. This indirect method of control is accomplished by opening or closing the control valve located in the line feeding the vaporized crude liquid oxygen to the low pressure column. As the pressure of the vaporized crude liquid oxygen is increased, its boiling point temperature is warmed. As this temperature is raised, the necessary temperature required to condense the crude argon is also raised. The pressure of the condensing crude argon is thus increased which reduces the differential pressure driving force between the low pressure column and the top of the crude argon column, resulting in a reduced flow. Conversely, decreasing the pressure of the vaporizing crude liquid oxygen will increase the flow to the crude argon column. For any required flow to the crude argon column, there will be a corresponding vaporizing pressure of the crude liquid oxygen and hence, a specific pressure drop across the control valve.

The present invention accomplishes the task of maximizing argon recovery by setting the pressure of the vaporized crude oxygen at its minimum value, i.e. the low pressure column pressure plus a small pressure drop. This results in the lowest possible pressure in the argon sidearm column consistent with the design temperature difference across the argon sidearm column condenser.

It is necessary with the minimum temperature difference across the argon sidearm column condenser to reduce the pressure of the feed from the low pressure column to the argon column by using a control value to obtain the maximum argon recovery. The preferred pressure range for the feed gas to the argon sidearm column is from about 1.5 psig to about 15 psig.

The excessive pressure of the vaporized crude oxygen in the conventional or prior art is converted in the present invention to a lower operating pressure in the argon sidearm column. The flowrate to the crude argon column is then set by restricting the flow with the feed control valve. This permits the crude argon column to operate at a reduced pressure and at the correct feed flowrate. This takes advantage of the inherent improved separation capability at the lower operating pressure which results in a higher argon recovery.

To demonstrate the efficacy of the present invention and to illustrate the increased argon recovery and production achieved by using the process of the present invention, two examples were computer simulated. Each example has four variations and has been simulated for both conventional distillation tray internals and structured packing internals and both the conventional control system and the control system of this invention.

Example I: Gaseous oxygen purity 99.5%, $N_2$ flow from high pressure column 0.21 mol/mol air flow to high pressure column.

Example II: Gaseous oxygen purity 99.7%, $N_2$ flow from high pressure column 0.10 mol/mol air flow to high pressure column.

The results for these two examples is given below:

| DISTILLATION SYSTEM: | TRAY COLUMN | | PACKED COLUMN | |
|---|---|---|---|---|
| CONTROL SYSTEM | CONVENTIONAL | NEW | CONVENTIONAL | NEW |
| Example I: | | | | |
| Argon recovery: % | 49.07 | 49.30 | 58.76 | 59.58 |
| Argon production: % | 100 | 100.47 | 100 | 101.4 |
| Example II: | | | | |
| Argon recovery: % | 68.33 | 69.28 | 90.65 | 90.85 |
| Argon production: % | 100 | 101.39 | 100 | 100.22 |

Note that the control system of the present invention increases argon production by 0.2 to 1.4% which given the value of argon is significant. Argon recovery is defined as contained argon in the argon production divided by the argon in the feed air to the plant.

Using the control valve in the feed to the argon sidearm column, as is proposed in this invention, rather than operating the argon column at virtually the pressure of the feed from the low pressure column, as in the conventional method, allows the argon column to operate at a lower pressure.

This lower pressure results in a better argon:oxygen separation due to the increase of the relative volatility of argon relative to oxygen. Although the increase is seemingly small (e.g., the packed column example increase is from 1.1198 to 1.1267), the increase is nevertheless significant since the relative volatility is close to unity and there are 40 to 50 transfer units in the argon sidearm column.

The present invention has been described with reference to a specific embodiment thereof. This embodiment should not be seen as a limitation of the scope of the present invention, the scope of which should be ascertained by the following claims.

We claim:

1. In a process for the separation of mixtures, which comprise oxygen, nitrogen, and argon, by cryogenic distillation in a distillation unit comprising an argon sidearm column with an overhead condenser and a low pressure column, wherein the argon sidearm column integrally communicates with the low pressure column, the improvement for increasing argon recovery comprises reducing the pressure of feed gas withdrawn from a lower-intermediate location of the low pressure column and fed to a lower location of the argon sidearm column whereby the operating pressure of the argon sidearm column is controlled at the lowest effective pressure which is consistent with a minimum temperature difference across the overhead condenser and an unrestricted return of crude oxygen vapor from the overhead condenser of the argon sidearm column to the low pressure column.

2. The process of claim 1 wherein the mixture comprising oxygen, nitrogen and argon is air.

3. The process of claim 1 wherein the low pressure column and argon sidearm column have structured packing internals.

4. The process of claim 1 wherein the low pressure column and argon sidearm column have distillation tray internals.

5. The process of claim 1 wherein the reduced pressure of the feed gas to the argon sidearm column is in the range from about 1.5 psig to about 15 psig.

* * * * *